US005928383A

United States Patent [19]

Russell et al.

[11] Patent Number: 5,928,383

[45] Date of Patent: Jul. 27, 1999

[54] CHEMICALLY ASSISTED PROTEIN ANNEALING TREATMENT

[75] Inventors: Ian Maxwell Russell, Highton; Anthony Paul Pierlot, Lethbridge, both of Australia

[73] Assignee: The Commonwealth Scientific and Industrial Research Organization, Australia

[21] Appl. No.: 08/809,937

[22] PCT Filed: Oct. 17, 1995

[86] PCT No.: PCT/AU95/00682

§ 371 Date: Jun. 3, 1997

§ 102(e) Date: Jun. 3, 1997

[87] PCT Pub. No.: WO96/12057

PCT Pub. Date: Apr. 25, 1996

[30] Foreign Application Priority Data

Oct. 17, 1997 [AU] Australia ..... PM8852/94

[51] Int. Cl.[6] ..... D06M 11/01; D06M 11/52; D06M 11/53; D06M 11/54

[52] U.S. Cl. ..... 8/128.3; 8/127.5; 8/127.51; 8/128.1; 8/127.6

[58] Field of Search ..... 8/127.5, 127.51, 8/128.1, 128.3, 127.6

[56] References Cited

U.S. PATENT DOCUMENTS 3,639,098 2/1972 Delmenico et al. ..... 8/127.5

FOREIGN PATENT DOCUMENTS 1326628 8/1973 United Kingdom .

OTHER PUBLICATIONS

WPAT abstract No. 92–239558/29, Jun. 1992.

WPAT abstract No. 91–372437/51, Nov. 1991.

WPAT abstract No. 91–372433/51, Nov. 1991.

*Primary Examiner*—Alan Diamond

*Attorney, Agent, or Firm*—Sughrue, Mion, Zinn, Macpeak & Seas, PLLC

[57] ABSTRACT

A method for treating proteinaceous materials that contain disulfide or polysulfide bonds to improve their performance at high relative humidity and when wet. The method comprises annealing the fabric at a temperature in the range of from 70° C. to 160° C. at a regain of between 10% and 25% for a period greater than about 10 minutes wherein the fabric is annealed in the presence of a gas which enhances the disulfide interchange reaction. A further embodiment of the invention comprises annealing the fabric at a temperature in the range of from 70° C. to 160° C. to a regain of between 10% and 25% for a period greater than 10 minutes wherein the fabric has at least in part been treated with a liquid which enhances the disulfide interchange reaction. The present method is particularly applicable to keratinous materials such as for example wool, wool with reduced crystallinity, mohair, regenerated protein, or mixtures thereof.

26 Claims, 8 Drawing Sheets

CHEMICALLY ASSISTED PROTEIN ANNEALING TREATMENT

This application is a 371 of PCT/AU95/00682 filed Oct. 17, 1995.

The present invention relates to a method for treating proteinaceous materials that contain disulfide or polysulfide bonds to improve their performance at high relative humidity and when wet. The present invention is particularly applicable to keratinous materials such as for example wool, wool with reduced crystallinity, mohair, regenerated protein, or mixtures thereof but is not limited thereto.

Wool is a composite polymer, consisting of water impenetrable, crystalline filaments embedded in an amorphous matrix that contains a high concentration of the amino acid cystine. The matrix is therefore highly crosslinked and occupies about 70% of the fibre volume. The hygroscopic nature of wool has also been attributed to the matrix regions. The amount of moisture present in a mass of fibres or a yarn or fabric is calculated as moisture regain. Moisture regain is the loss in weight of water upon bone-drying at 105° C. as a percentage of the dry fibre weight. The normal method for determining these values involves weighing, bone-drying, weighing, and calculating. Moisture-regain varies with the relative humidity (r.h.) of the atmosphere to which the fibres are exposed. (FIG. 1). The mechanical properties of the fibers are critically dependent upon moisture regain. A glass transition temperature ($T_g$) that is also sensitive to water content has been identified to occur in the matrix region of the wool fibre.

The glass transition temperature is the temperature at which the material changes from being in a state where it behaves as a glass, at temperatures below Tg, to being in a state where it behaves as a rubber, at temperatures above Tg. At relative humidities higher than about 90%, proteinaceous materials begin to absorb large amounts of water. It is believed to be the water absorption, especially the large amount at relatively high humidity which may cause proteinaceous materials to change from the "glassy" to the "rubbery" state. It is believed that this transition is accompanied by a deterioration in the performance of proteinaceous materials. For example, fabrics made from these materials will suffer from high hygral expansion and a deterioration in the mechanical properties for example modulus (see Table 1 for example), bending rigidity, drape, wrinkle recovery etc. as the water content increases. Many chemical treatments are known to reduce the water content at higher relative humidity (Eg. 4) but none are practical as they require treatment with large amounts of chemical or cause excessive damage to the material or result in an unacceptable colour change.

TABLE 1

Relative Hookean Modulus as a Function of Relative Humidity for Wool

| Relative Modulus | Relative Humidity (%) |
|---|---|
| 1.13 | 0 |
| 1.10 | 3.6 |
| 1.00 | 31.8 |
| 0.93 | 44.2 |
| 0.86 | 65.5 |
| 0.76 | 77.7 |
| 0.58 | 90.5 |
| 0.48 | 97.7 |
| 0.41 | 100 |

Methods for the dimensional stabilisation or setting of wool fibres, in a desired geometrical configuration, have been and still are the subject of considerable study. Methods which have been used to improve the resistance of wool and cotton articles to wrinkling and creasing are described in UK Patent Specification 1299377 and 1326628. 1299377 describes a method for increasing the resistance to, and recovery from, deformation of a textile material, the process comprising subjecting the material to an annealing treatment by maintaining the material at a temperature within the range of 30° C. to 120° C. for a period of more than 20 minutes, while maintaining the regain of the fibres at a value corresponding to a relative humidity of from 60% to 95%. The increase in resistance to and recovery from deformation was attributed to the rearrangement of labile hydrogen bonds within the wool fibres to more stable (i.e. low energy) configurations under conditions of increased temperature and/or regain. Conditions of increased temperature and/or regain brought about rupture of strained hydrogen bonds and as the temperature and/or region are slowly reduced the hydrogen bonds progressively reform and in so doing take up configurations possessing the lowest possible energy.

1326628 describes a method for increasing the resistance to, and recovery from, deformation of a textile material, the process comprising subjecting the material to an annealing treatment by maintaining the material at a temperature within the range of from 30° C. to 150° C. for a period greater than 5 minutes, while maintaining the regain of the fibres at a value corresponding to a relative humidity of from 50% to 95%. The process further comprises treating the material either before, during or after annealing with a multi-functional compound which possesses at least two reactive sites capable of cross-linking the textile fibre. A typical chemical system according to 1326628 which imparts a high degree of stabilisation of the annealed state is a system of resorcinol-formaldehyde.

"Traditional annealing" describes the process of annealing wool to impart a degree of wrinkle recovery significantly higher than wool which has not been treated. This traditional annealing process is also known to cause a small reduction in the saturation regain of the wool.

Despite continued attempts over many decades to improve wrinkle recovery by chemical treatments traditional annealing has remained the most practical and provides the largest improvement in wrinkle recovery. Unfortunately when wool is annealed in the traditional manner the improvement in wrinkle recovery is not permanent as immersion in cold water or steam pressing will substantially eliminate the annealing benefit. Thus much effort has been directed at methods to improve the stability of the traditionally annealed state to immersion in cold water and steam pressing but with little success. The importance of a treatment to improve the wrinkle recovery of wool is well known and despite continual failures this area has remained high priority.

We have found that the disulfide interchange reaction which occurs to a limited extent during traditional annealing may be enhanced. "Disulfide interchange" is used to describe the rearrangement of the disulfide or cystine crosslinks in wool. The presence of thiol groups facilitates this rearrangement and occurs at about 70° C. in water and at higher temperatures as the regain is reduced. Stresses exerted through the disulfide bonds may be relieved by the process of the present invention as the disulfide bonds are rearranged.

The enhancement of the disulfide interchange reaction and subsequent crosslinking during annealing lowers the total amount of water which may be absorbed by the proteinaceous material (saturation regain). It is believed that the reduction in the saturation regain prevents, or at least reduces the likelihood of, the glass transition temperature of the material being exceeded at relatively high humidity or in cold water. Accordingly, the undesirable changes to the properties of the material on transformation to the "rubbery" state are avoided. This provides an improvement in the wet, or high relative humidity, properties of the proteinaceous materials. Properties such as wet modulus, wrinkle recovery etc. are thereby improved. In certain embodiments of the present invention permanent setting properties of fabrics made from these proteinaceous materials (permanent press) are also improved.

According to the present invention there is provided a process for treating fabric made from proteinaceous materials containing disulfide or polysulfide bonds comprising annealing the fabric at a temperature in the range of from 70° C. to 160° C. at a regain of between 10% and 25% for a period greater than about 10 minutes wherein the fabric is annealed in the presence of a gas which enhances the disulfide interchange reaction.

According to a further embodiment of the invention there is provided a process for treating a fabric made from proteinaceous materials containing disulfide or polysulfide bonds comprising annealing the fabric at a temperature in the range of from 70° C. to 160° C. to a regain of between 10% and 25% for a period greater than 10 minutes wherein the fabric has at least in part been treated with a liquid which enhances the disulfide interchange reaction.

The term "fabric" is used herein to describe woven or non-woven cloth. Non-woven fabrics include those made by knitting or felting or the like. The preferred fabric for treatment according to the present invention is a high quality worsted type. The term "fabric" includes articles made from fabrics including garments and the like.

The expression "proteinaceous materials containing disulfide or polysulfide bonds" includes keratin containing materials, wool, wool with reduced crystallinity, mohair, regenerated protein or mixtures thereof etc. Also included are blends, especially blends of wool with other natural fibres such as cotton, silk and the like and also synthetic materials such as polyester, nylon and the like. Throughout the specification the method of the invention will be explained with reference to wool and wool with reduced crystallinity but it is to be understood that the method is applicable to other forms of keratin and other proteinaceous material or mixtures thereof.

"Annealing" is used to describe the process of raising the temperature of the wool under conditions at which the moisture content of the wool is controlled. Although in annealing processes described in the literature slow cooling is usually required, in the present specification it is to be understood that controlled or slow cooling is not always necessary to impart the benefits claimed herein.

As a result of the present invention the properties of the fabrics which are improved at higher relative humidity and when wet include improvement of their resistance to and recovery from deformations; prevention of wrinkling of garments during wearing; improvement in their resistance to shrinkage and felting during laundering or dry cleaning; a reduction in their hygral expansion behaviour during exposure to conditions of high relative humidity or when wet; an increase in the elastic modulus of the material when wet or at high relative humidity, an improvement in the drape of a fabric made from the proteinaceous material at higher relative humidity or when wet; a prevention in the deterioration of dimensions and shape of such articles during use or washing, and during processing and manufacturing operations etc. The method of the present invention can also form part of a process for permanently setting the fabric and for improving their dimensional stability preferably with the addition of shrink resist treatments to improve machine washing and drying. The permanent set process may be used to improve the dimensional stability of a garment made from the fabric, to impart permanent pleats or three dimensional structure to the fabric such as, for example, embossing. The combination of the process of the present invention with a shrink resist process results in a fabric or garment with easy care characteristics.

The process of the present invention enables a permanent set to be imparted to a fabric, such as a garment, without significant loss of the original dimensions or cohesively set shape. The process of the present invention eliminates the need to restrain or hold the fabric in order to impart the permanent set.

The process of annealing at reduced regain and under conditions in which the disulfide interchange reaction will be enhanced allows the occurrence of disulfide crosslink rearrangement and therefore crosslinking of the matrix will occur in a state of swelling governed by the regain of the fibre at the time of treatment. This process results in reduced swelling at high relative humidity. It is believed that the occurrence of the disulfide crosslinking rearrangement results in a reduction in saturation regain. The formation of a permanent set which imparts the above-mentioned benefits is given by way of example only.

This invention achieves improved performance of fabrics, such as those comprising wool, by enhancing the disulfide interchange reaction during annealing, thereby reducing the amount of absorbed water when the proteinaceous material is wet or at a high humidity. This process also imparts permanent set to the fabric which also results in significantly improved performance.

Agents suitable for enhancing the disulfide interchange reaction may be used in the process of the present invention. Agents which are in the gas phase at the annealing temperature are particularly convenient in the process of the present invention as they may be introduced into the annealing atmosphere in order to enhance the disulfide interchange reaction. Gases which enhance the disulfide interchange reaction during annealing include for example, thiol reducing agents for example hydrogen sulfide, polysulfides of the form $H_2S_2$, $H_2S_3$, $H_2S_4$ etc, thioglycollic acid, 1,4-dithiothreitol, mercaptoethanol, benzyl mercaptan, ethanethiol, benzenethiol, 2-aminoethanethiol etc; reducing agents such as phosphines for example phosphine, tris (hydroxymethyl)phosphine, tri-n-butylphosphine, triethylphosphine and tertiary phosphines derived from phosphine by reaction with amines and formaldehyde; other reducing agents for example triethyl phosphite, sulfur dioxide and the like. We have found that hydrogen sulfide ($H_2S$) is a preferred gas for enhancing the disulfide interchange reaction during annealing.

Other agents for enhancing the disulfide interchange reaction may be used in liquid form, typically neat or in the form of a solution or a dispersion. Such liquids which enhance the disulfide interchange reaction include thiol reducing agents for example hydrogen sulfide, polysulfides of the form $H_2S_2$, $H_2S_3$, $H_2S_4$ etc, thiogycollic acid, 1,4-dithiothreitol, mercaptoethanol, benzyl mercaptan, ethanethiol, benzenethiol, 2-aminoethanethiol, cysteine etc; reducing agents such as phosphines for example phosphine, tetrakis(hydroxymethyl)phosphonium chloride, tris (hydroxymethyl)phosphine, tri-n-butylphosphine, triethylphosphine and tertiary phosphines derived from phosphine by reaction with amines and formaldehyde; other reducing agents for example triethyl phosphite, borohydride, bisulfite, sulfite, dithionite, monoethanolamine sesquisulfite, sulfide, hydrosulfide, sulfur dioxide etc; thiolating agents for example acetylmercaptosuccinic anhydride, N-acetyl-homocysteine thiolactone, homocysteine thiolactone, thioglycolides etc. Preferably the liquid which enables the disulfide interchange reaction is selected from the group consisting of hydrogen sulfide, thiogycollic acid, 1,4-dithiothreitol, mercaptoethanol, benzyl mercaptan, ethanethiol, benzenethiol, cysteine, bisulfite, sulfite, dithionite, monoethanolamine sesquisulfite, sulfide, hydrosulfide, sulfur dioxide and thioglycolides.

Such agents in liquid form are conveniently applied to the fabric by dabbing or soaking the fabric in the region where the improved properties of wrinkle resistance and permanent setting are desired prior to annealing. Combinations of the use of gases and liquids to enhance the disulfide interchange reaction may also be used. It will be understood that some liquids which may be applied to the fabric prior to annealing may also vaporise during annealing and also act as a gas phase agent for enhancing the disulfide interchange reaction at the annealing temperature. In another embodiment of the present invention a liquid reagent may be used to dab or soak the desired region of the fabric, which reagent may vaporise to form a gas which enhances the disulfide interchange reaction during the annealing process.

Numerous compounds are available and many, but not all are described in Maclaren, J. A.; Milligan, B.; in "Wool Science, The Chemical Reactivity of the Wool Fibre", Science Press, Australia, 1981 and the numerous references therein.

It has been found that $H_2S$ is a particularly suitable gas for enhancing the disulfide interchange reaction. The reaction of $H_2S$ with wool will therefore be discussed with reference to $H_2S$ as the agent which enhances the disulfide interchange reaction. The disulfide interchange reaction and enhancement due to the introduction of additional thiols is however applicable to other agents either in the form of a gas or liquid that enhance the disulfide interchange reaction and introduce these additional disulfide interchange enhancing thiols.

The scheme which is discussed below outlines the important reactions which are postulated to occur during annealing of wool and in the method of the present invention. The inventors do not wish however to be bound to any particular theory.

The reaction of $H_2S$ with disulfides in proteins results in the formation of a hydrodisulfide and a thiol (2) while the analogous reaction that occurs in wool forms the hydrodisulfide or perthiocysteine residue, from the cystine residue as shown in scheme (1) below. Disproportionation of cystine may also form perthiocysteine, but is accompanied by formation of dehydroalanine as shown in scheme (2).

Thiols can add spontaneously to the β-position of carbonyl-activated double bonds (2). A similar reaction between dehydroalanine and cysteine occurs in wool and results in the formation of lanthionine as shown in scheme (3). It is expected that addition of $H_2S$ to dehydroalanine as shown in scheme (4) is also possible.

(1)

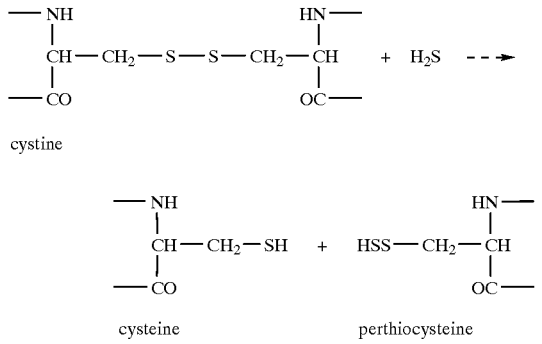

(2)

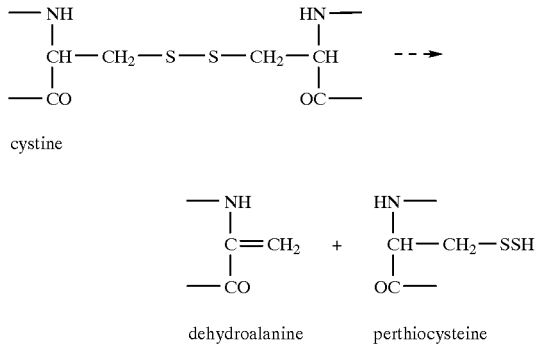

(3)

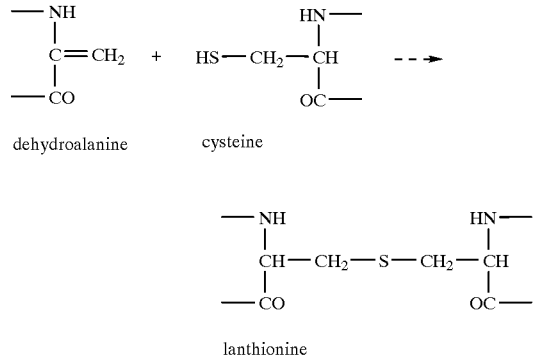

(4)

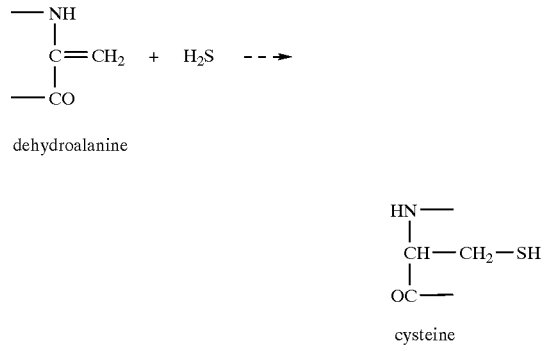

These are the major reactions that are believed to be responsible for the chemical changes that occur during traditional annealing or annealing in the presence of $H_2S$. Without the presence of $H_2S$ during annealing or when only a small number of thiols are present the disulfide interchange reaction will eventually be inhibited due to the removal of the catalysing thiols through reaction with dehydroalanine. The presence of additional thiols during annealing enhances the disulfide interchange reaction and allows it to proceed to a state where the reformed disulfide crosslinking network is capable of inhibiting the absorption of water at high relative humidity. A total sulfur analysis of wool annealed in the presence of $H_2S$ shows an increase in sulfur content of approximately 40 $\mu$mol/g of dry wool indicating that this is the overall extent of reaction and number of additional thiols formed.

The oxidation or blocking of excess thiols after annealing may be desirable in some applications. Accordingly in a preferred embodiment the wool is further treated, after annealing in the presence of an agent which enhances the disulfide interchange reaction or after annealing in which an excess of thiols were introduced before annealing, with an additional reagent to oxidise or block excess thiol groups. This can be achieved in any suitable manner by reaction to remove or convert thiols to species that do not catalyse the disulfide interchange reaction. Numerous compounds are available to achieve this, for example, hydrogen peroxide, peracids, acrylonitrile, formaldehyde, benzoquinone, ethylene oxide, ozone, oxygen, epoxypropane, butadiene diepoxide, butadiene monoxide, trimethylene oxide with many but not all represented in Maclaren, J. A.; Milligan, B.; in "Wool Science, The Chemical Reactivity of the Wool Fibre", Science Press, Australia, 1981 and given by way of example only. This reaction may be carried out in the gas phase, in solvents including water or if desired by using an aerosol of the required chemical. By way of example, acrylonitrile, hydrogen peroxide, peracetic acid, oxygen and benzoquinone are exemplified hereunder. Other treatments are of course possible and may include reactive nucleophiles which react to form additional crosslinks or to replace existing crosslinks with more stable ones, for example, the disulfide crosslink may be replaced by the more stable lanthionine crosslink by reaction with cyanide.

The actual treatment conditions which may be used to perform the method of the present invention may vary considerably. The variables of time of annealing, temperature, regain and the amount of agent for enhancing disulfide interchange are interrelated and to an extent complementary. The preferred treatment conditions are to anneal with approximately 15% regain; at a temperature of approximately 100° C.; for a time of approximately 4 hours; for additional thiols between about 5 and about 400 $\mu$mol/g of dry fabric with approximately 40 $\mu$mol/g of dry fabric being more preferable. In general the upper limit of temperature will be set lower than that at which the fabric becomes permanently damaged for example by discolouration while the lower limit will be determined by the economics of time.

The regain may be controlled by accurate control of the relative humidity surrounding the fabric. Control of the relative humidity may be achieved in any suitable manner and may include, for example, by preconditioning the fabric to the desired regain at a convenient temperature followed by annealing in a chamber in which the mass of fabric to volume ratio can be used to obtain the desired regain at the annealing temperature, by combining gas streams of different moisture contents at the appropriate mix to obtain the desired relative humidity and hence regain, by electronic control with feedback using sensors, for example capacitance devices or dew point sensors etc to measure relative humidity or by heating water that contains dissolved substances in the correct proportions so as to lower the vapour pressure of water above the solution to the desired relative humidity. The relative humidity of the atmosphere surrounding the fabric may be in the range of from 30 to 95%, preferably in the range of from 75 to 85%.

The present invention results in a significant reduction in the water absorption at high relative humidity (FIG. 1) and therefore improves those properties that deteriorate as the water content increases due to the inherent approach or exceeding the glass transition. The reduction in water absorbed at high relative humidity beyond that achieved by traditional annealing is believed to occur because of the enhanced extent of disulfide bond rearrangement brought about by chemical treatments that introduce additional thiols into the wool and the change in the structure of the crosslinking that occurs during the chemically assisted annealing process. In the traditional annealing process, only a modest amount of permanent set occurs so that the extent of crosslinking rearrangement is thought not to be complete at the equilibrium configuration appropriate to the regain of annealing. It has been found that the annealing treatment may be chemically enhanced. It has been found that the presence of a small amount of a chemical agent may enhance the disulfide interchange reaction or a chemical agent may be used to introduce additional thiols and enhances the disulfide interchange reaction, either before or during annealing. It is believed that the chemical agent causes massive disulfide rearrangement to occur and therefore form a new crosslinked network able to restrict the amount of water absorbed.

BRIEF DESCRIPTION OF THE DRAWINGS

The invention will be more fully described with reference to the examples and drawings which are provided by way of example only and in which:

FIG. 8: shows the permanent set that is imparted with the fabric either restrained or unrestrained. The fabric was treated as for example 1b. The level of set imparted to the fabric in a restrained configuration was obtained by stitching in place a 180° pleat in the wool fabric prior to treatment. The level of set imparted to fabric in an unrestrained configuration was obtained by cohesive setting by steam pressing (10 s steam, 10 s vacuum) a pleat in the fabric that was allowed to hang freely during treatment. After annealing snippets of yarn were allowed to relax in water at 50° C. for 30 minutes and their angle measured; the extent of set expressed as a percentage is given by 100×(180−angle)/180. The oxidised unrestrained values are for fabric that has been given an after treatment as outlined in example 8a.

Figure 1:
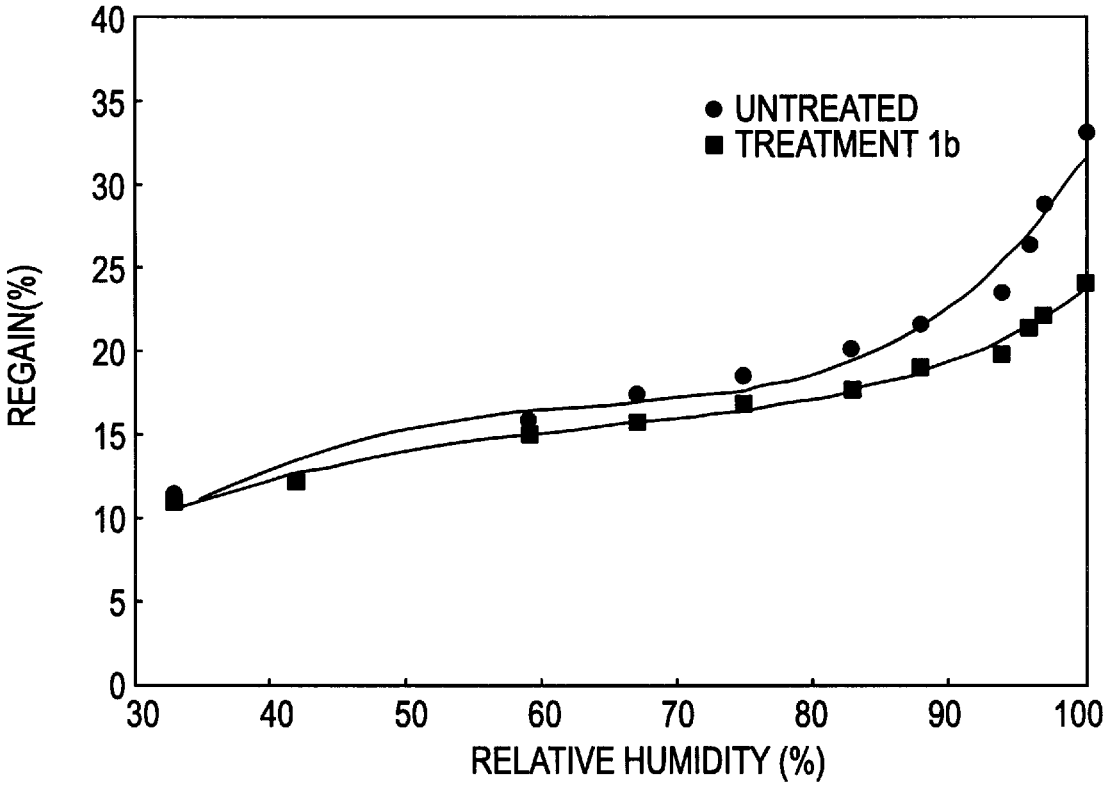
FIG. 1: is a graph of the absorption isotherm of untreated wool and wool treated as for example 1b showing the significant reduction in regain at high relative humidity.
Figure 2:
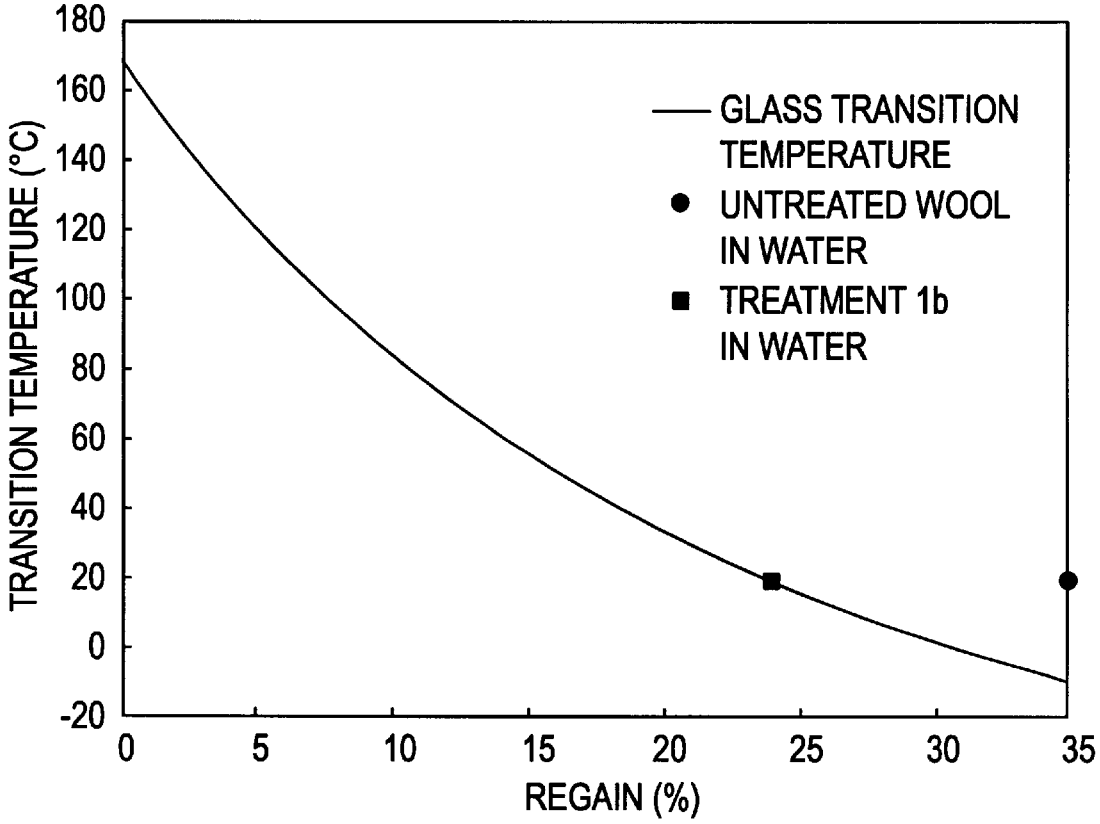
FIG. 2: is a graph showing the depression of the glass transition temperature of wool with increasing water content. The state of the wool is also indicated relative to the glass transition temperature for untreated wool and wool treated as in example 1b showing that the treatment prevents the wool from exceeding the glass transition temperature.
Figure 3:
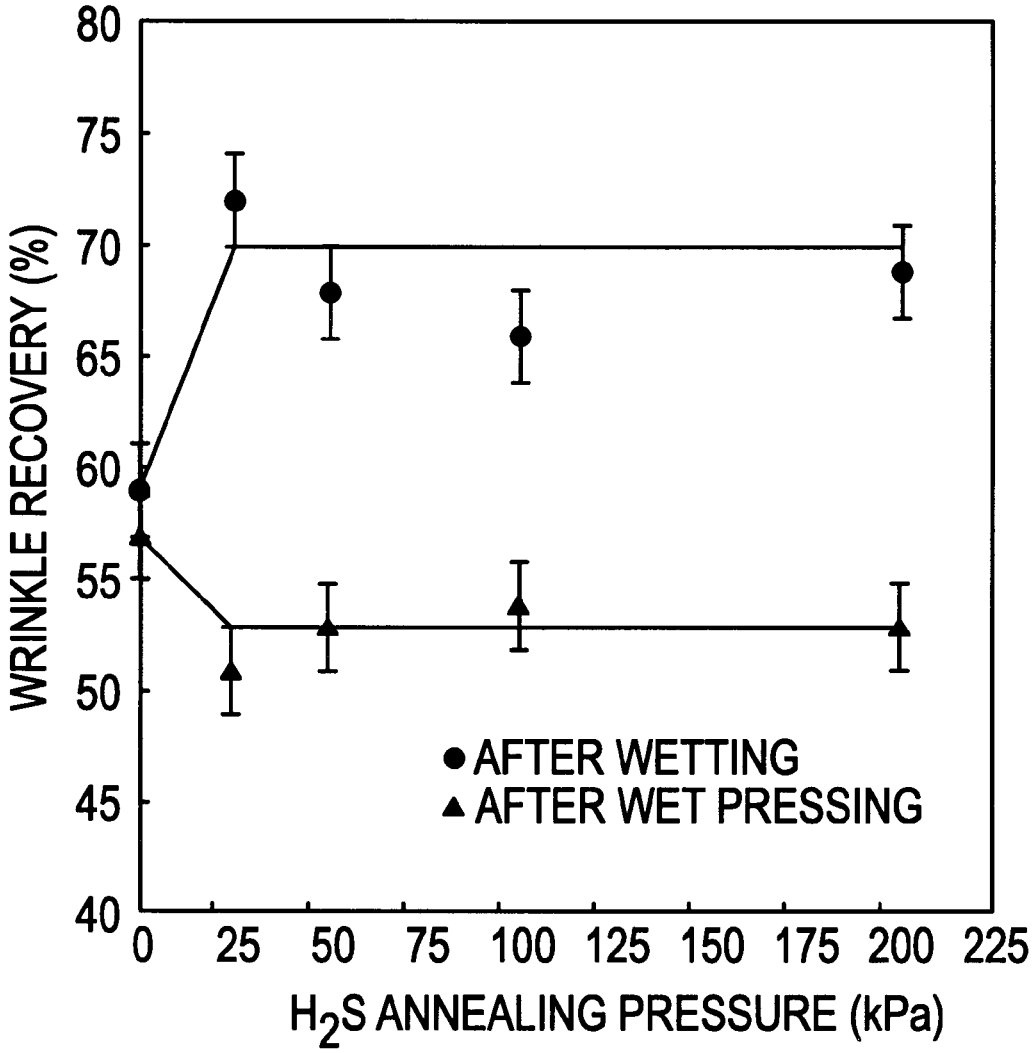
FIG. 3: is a graph of the wrinkle recovery as measured by the thermobench test (Leeder, J. D.; Textile Res. J., 45, 581, 1975) after the treated wool is immersed in water for 30 minutes or immersed in water for 30 minutes and then steam pressed while still wet. The treatment conditions were similar to treatment 1b but with wool at 19.5% regain and various pressures of $H_2S$. This graph shows the significant improvement in wrinkle recovery that is stable to cold water but not to steam pressing. Untreated wool has a wrinkle recovery of 54% as determined by this method.
Figure 4:
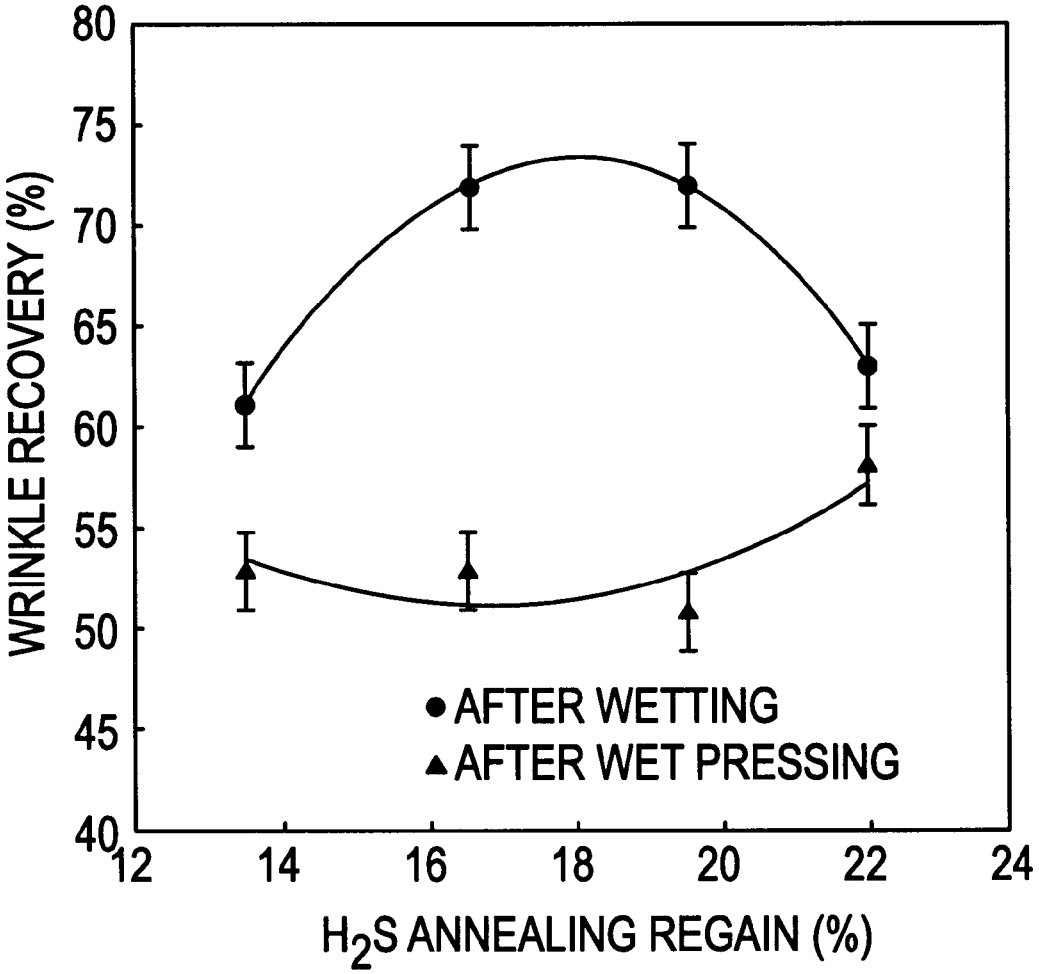
FIG. 4: shows the importance of controlling the regain during the treatment as in example 1b. The wrinkle test method is as given for FIG. 3 above.
Figure 5:
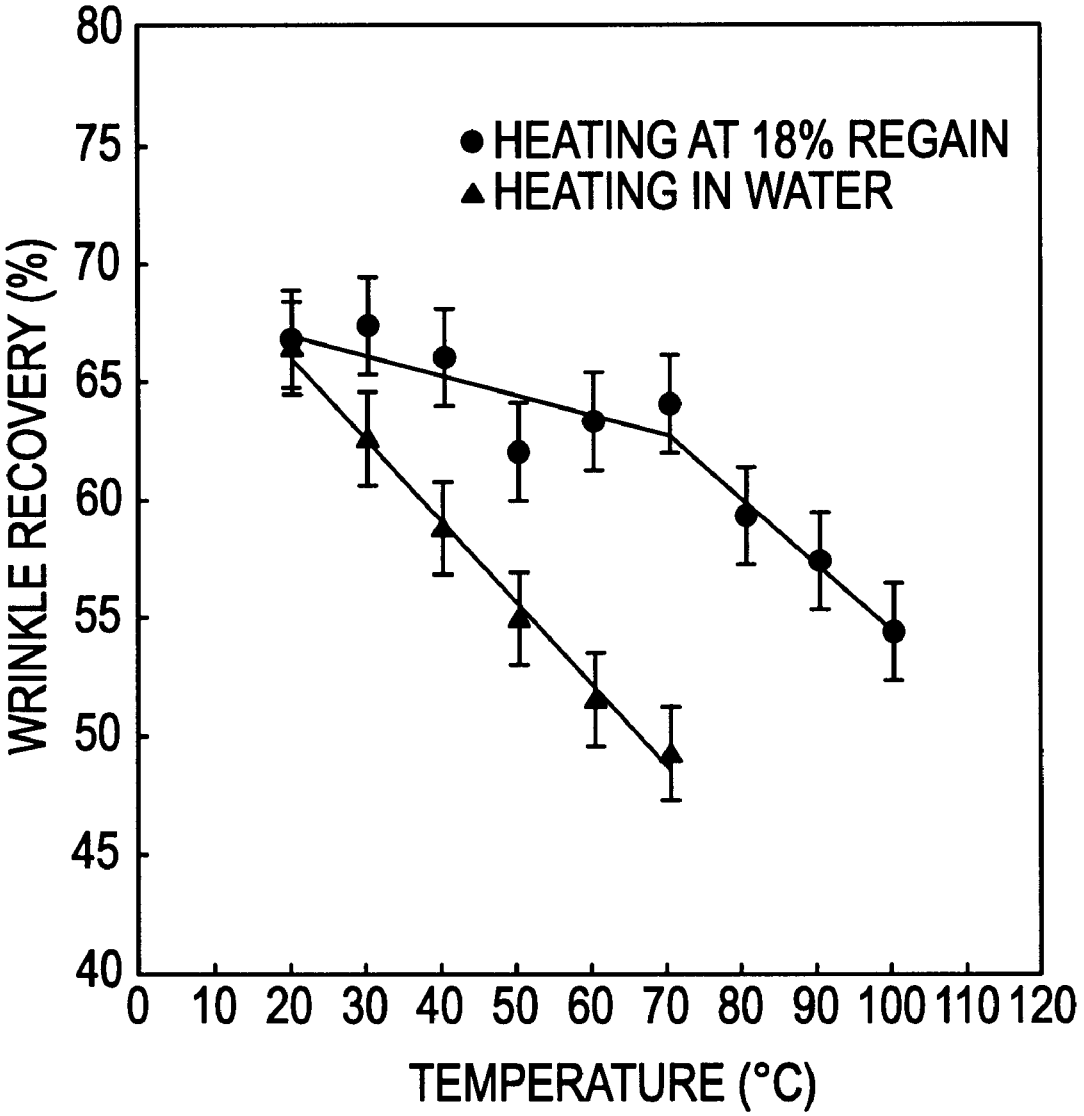
FIG. 5: shows the effect of a subsequent heat treatment on the fabric as treated in example 1b. After heating in water or air for 30 minutes the wrinkle recovery deteriorates (but more rapidly for water) to the value obtained for the untreated fabric. Wrinkle recoveries were determined as given for FIG. 3.
Figure 6:
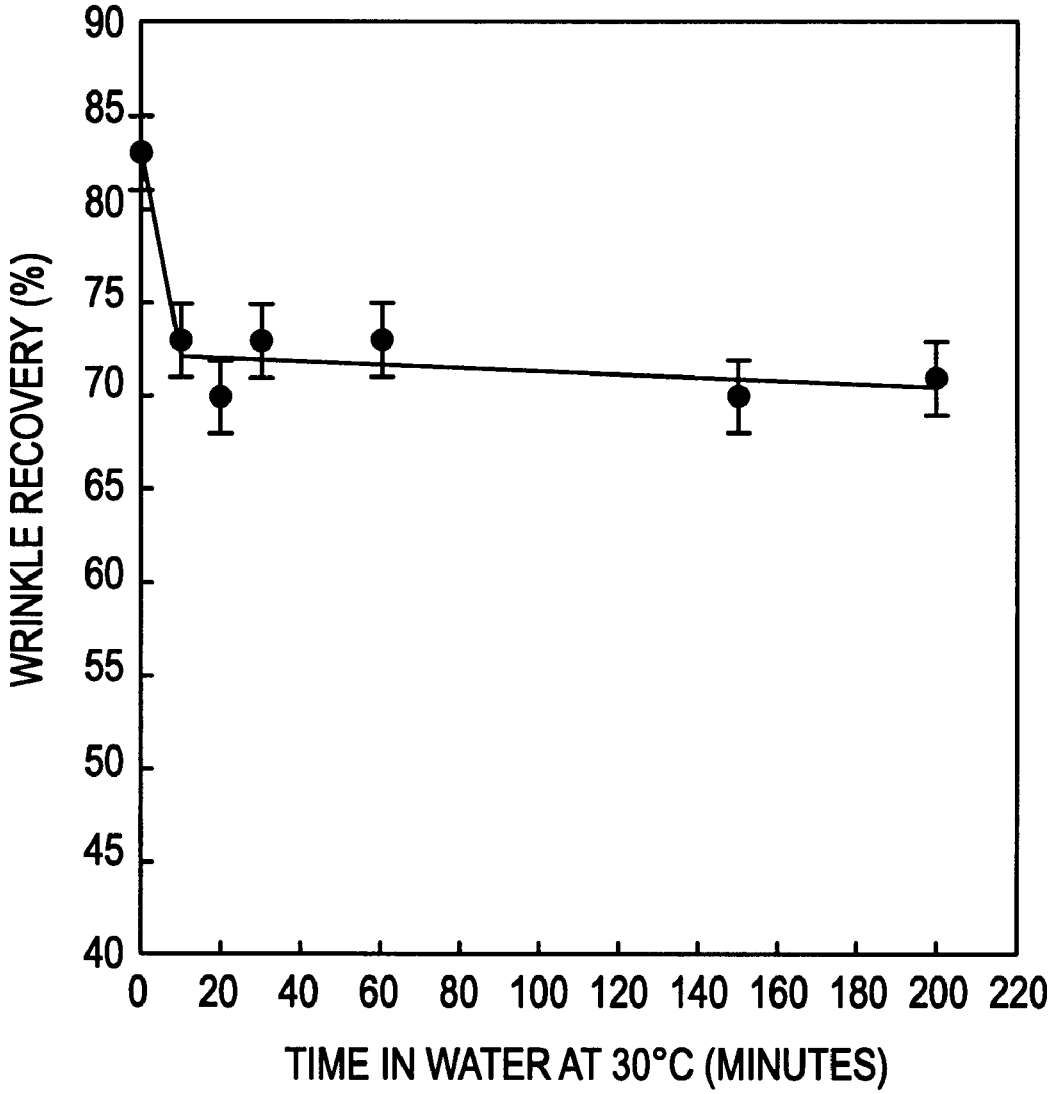
FIG. 6: shows that the improvement in wrinkle recovery from the treatment as given in example 1b is relatively stable to the time of exposure.
Figure 7:
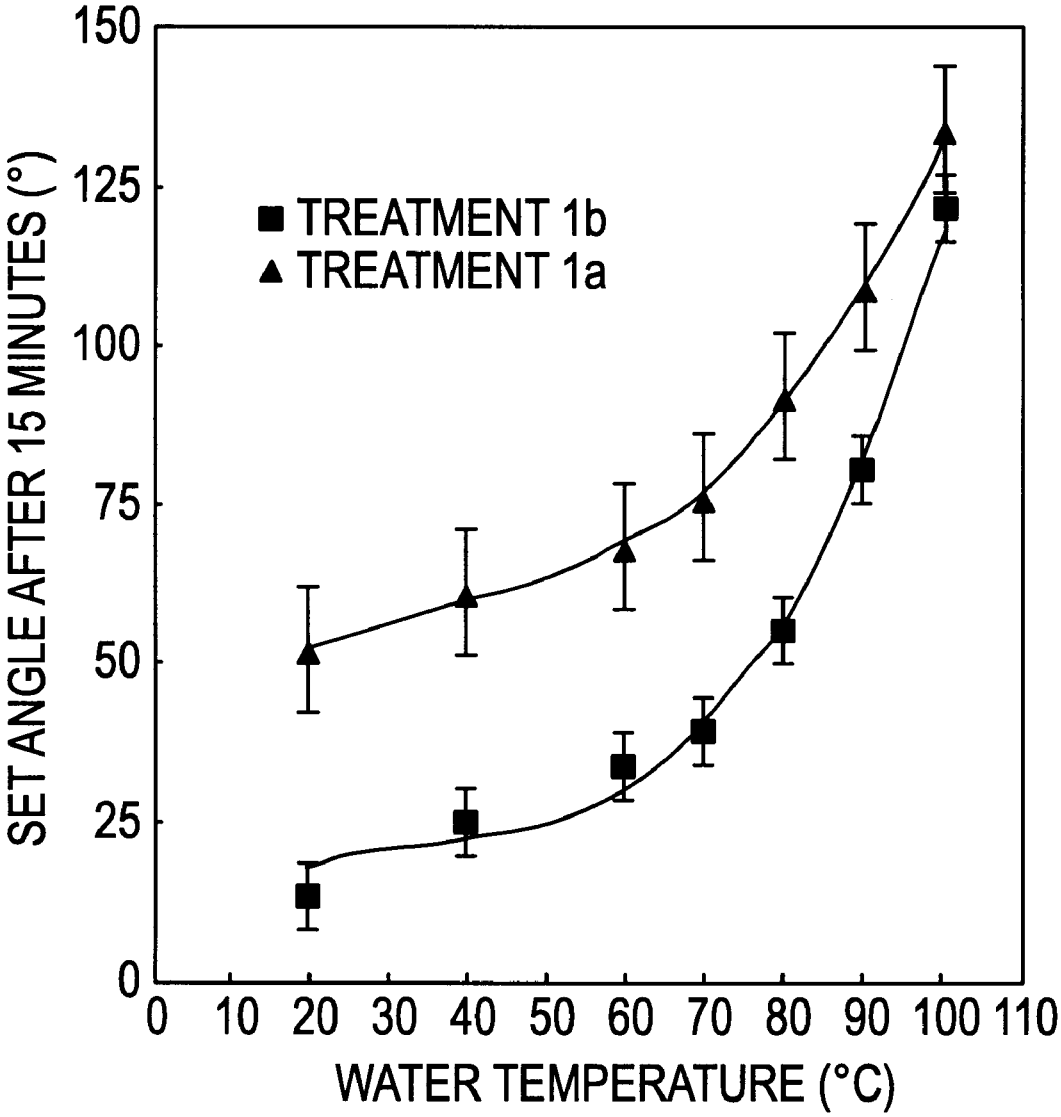
FIG. 7: shows the increased level of set that is imparted to the fabric as a result of treatment as for example 1b compared to treatment as for example 1a. The level of set was obtained by stitching in place a 180° pleat in the wool fabric prior to annealing. After annealing and removal of the stitches, snippets of yarn were allowed to relax in water for 15 minutes and their angle measured; the smaller the angle the larger the degree of set.

Example 1 shows the reduction in saturation regain that can be obtained by enhancing the disulfide interchange reaction during annealing by the presence of $H_2S$.

Example 2 shows the reduction in saturation regain that can be obtained by the introduction of additional thiols prior to annealing.

Example 3 shows the improved wrinkle recovery of treated wool fabric.

Example 4 shows the improved shrink resistance of treated wool fabric.

Example 5 shows the increased wet modulus of fibres of treated wool.

Example 6 shows the reduction in saturation regain of wool in which part of its crystallinity has been destroyed.

Example 7 shows the increased wet modulus of a wool that had been previously treated to reduce its crystalline fraction.

Example 8 shows the increased stability of the treated state to wet steam pressing when the additional thiols formed during the treatment are removed by a subsequent treatment.

Example 9 shows the permanent set imparted to fabric that is treated in an unrestrained manner.

Example 10 demonstrates the easy-care properties imparted by the treatment.

Example 11 shows the improved smooth dry performance of the treated fabric (recovery from wrinkles inserted when the fabric is wet).

Example 12 shows the improvement in hygral expansion of the treated fabric.

EXAMPLES

Example 1

The Effect of Treatment on Saturation Regain

A pure wool fabric of plain weave construction (176 g/m$^2$, wool fibres of 21 $\mu$m diameter) was used. Saturation regains were determined by immersing the samples in water for 30 minutes with a small amount of detergent, centrifuging to remove excess water, weighing and reweighing after the samples were dried in an oven at 105° C. for 1 hour under vacuum.

Example 1a 10 g of fabric was annealed in the traditional manner by conditioning the fabric to 75% relative humidity and annealing at 100° C. for 4 hours in a 275 ml vessel in the absence of air followed by slow cooling.

Example 1b 10 g of fabric was conditioned to 75% relative humidity and was annealed at 100° C. for 4 hours in a 275 ml vessel in the absence of air but in the presence of 25 kPa (300 $\mu$mol/g dry wool) of $H_2S$ followed by slow cooling.

Example 1c

Treatment as for Example 1b but followed by an additional treatment to block excess thiols by reaction with acrylonitrile vapour for 30 min at 100° C.

| Treatment | Saturation Regain/% |
|---|---|
| Untreated | 34 |
| Example 1a | 30 |
| Example 1b | 22 |
| Example 1c | 26 |

A small reduction in saturation regain is apparent for wool annealed in the traditional manner in which no $H_2S$ is present or in which no additional thiols have been introduced into the wool. However this reduction is small in comparison to what is achieved by the presence of $H_2S$.

Example 2

Alternative chemicals to $H_2S$ that introduce additional thiols before annealing are possible. After annealing wool in which additional thiols have been generated a significant reduction in saturation regain is possible.

Example 2a 10 g of fabric was soaked in 500 ml of water containing 5 g/l of sodium metabisulphite ($Na_2S_2O_5$) at 20° C. for 3 hours. The fabric was then well rinsed, conditioned to 75% r.h. and then annealed in the absence of air for 4 hours at 100° C. followed by slow cooling.

Saturation Regain=28%

Example 2b

As for Example 1b but using sodium dithionite ($Na_2S_2O_4$).

Saturation Regain=28%

Example 2c 20 g of fabric was soaked in water saturated with $H_2S$ for 1 hour at 20° C. The fabric was removed and well rinsed to remove any residual smell. The fabric was then conditioned to 75% r.h. and annealed in the absence of air for 4 hours at 100° C. followed by slow cooling.

Saturation Regain=27%

Examples 3–5 show the significant change that is possible in the properties of wool that have a lower saturation regain achieved through the chemical annealing process.

Example 3

Wrinkle Recovery Improvement

A substantial improvement in wrinkle recovery as measured by the Multiple Pleat Test (3) was obtained for the fabrics that were annealed as in Example 1. The wrinkle recovery was measured after the samples were immersed in water and allowed to condition for 1 day.

| Treatment | Wrinkle Recovery (%) |
|---|---|
| Untreated | 53 |
| Example 1a | 54 |
| Example 1b | 70 |
| Example 1c | 65 |
| Example 2a | 60 |
| Example 2b | 61 |
| Example 2c | 61 |

These results clearly show a substantial improvement in wrinkle recovery. This improvement is readily noticeable during wear as a 5% improvement has been shown to be just discernible during wear.

Example 4

Shrink Resist Improvement

Fabric and treatment as in Example 1b and 1c. The area shrinkage after washing in a wascator on the 5A cycle using the standard test method (IWS TM31) was determined.

| Treatment | Area shrinkage (%) |
|---|---|
| Untreated | 7 |
| Example 1b | 3 |
| Example 1c | 3 |

A significant reduction in the shrinkage of the fabric is obtained by the treatment.

Example 5

Wet Modulus Increase

The wet modulus at an extension rate of 10%/min of 3 fibres within the Hookean region was measured prior to treatment and after the treatment given in Example 1b.

Relative Modulus=treated/initial=1.25

This represents a substantial improvement in the wet stiffness of the fibre.

To demonstrate the applicability of the treatment to fibres other than wool and to regenerated protein which is a poorer fibre as it generally contains little crystallinity, wool was modified to lower its crystallinity and given the treatment as outlined in Example 1a, 1b and 1c.

Example 6

Saturation Regain of Wool Modified for Reduced Crystallinity

The saturation regain of wool which had partial crystallinity destruction was determined.

| Treatment | Saturation Regain (%) |
|---|---|
| Untreated | 36 |
| Example 1a | 30 |
| Example 1c | 22 |

Example 7

Wet Modulus Increase of Wool Modified for Reduced Crystallinity

The wet modulus of wool which had partial crystallinity destruction was determined at an extension rate of 100%/min. The average of 50 fibres is given. The fibres were treated according to the treatment given in Example 1a and also according to the treatment given in Example 1b and 1c.

| Treatment | Wet Modulus (N/Tex) |
|---|---|
| Untreated | 0.50 |
| Example 1a | 0.75 |
| Example 1b | 1.53 |
| Example 1c | 1.10 |

Example 8

Saturation Regions of Treated Wool after Removal of Additional Thiols and Wet Steam Pressing Fabric was treated according to Example 1b. This fabric was then further treated by Example 8a Oxidation by reaction with a 2% solution of hydrogen peroxide in water at 20° C. for 30 minutes.

Example 8b

Reaction with acrylonitrile vapour by heating fabric in the absence of air with acrylonitrile to 100° C. for 1 hour followed by slow cooling.

Example 8c

Reaction with peracetic acid vapour by heating fabric in the absence of air with peracetic acid vapour at 100° C. for 1 hour.

Example 8d

Reaction with benzoquinone vapour by heating fabric in the absence of air with benzoquinone to 100° C. for 1 hour.

Example 8e

Reaction with an aerosol of 10% hydrogen peroxide/water by generating an aerosol with an ultrasonic humidifier and allowing the droplets to contact the fabric.

Example 8f

Reaction with oxygen by heating to 100° C. in the presence of oxygen for 1 hour.

The above treated fabrics were then wet out in water at 20° C. for 30 minutes and while still wet were given a steam press that consisted of 10 s of steam and 10 s of vacuum. The improved stability of the reduced regain state of the wool after the additional thiol removing treatment is demonstrated in the table below.

| Treatment | Saturation Regain after Wet Pressing/% |
|---|---|
| Example 1b | 37 |
| Example 8a | 32 |
| Example 8b | 29 |
| Example 8c | 34 |
| Example 8d | 34 |
| Example 8e | 34 |
| Example 8f | 33 |

Example 9

Permanent Set of Wool Imparted when Unrestrained

Figure 8:
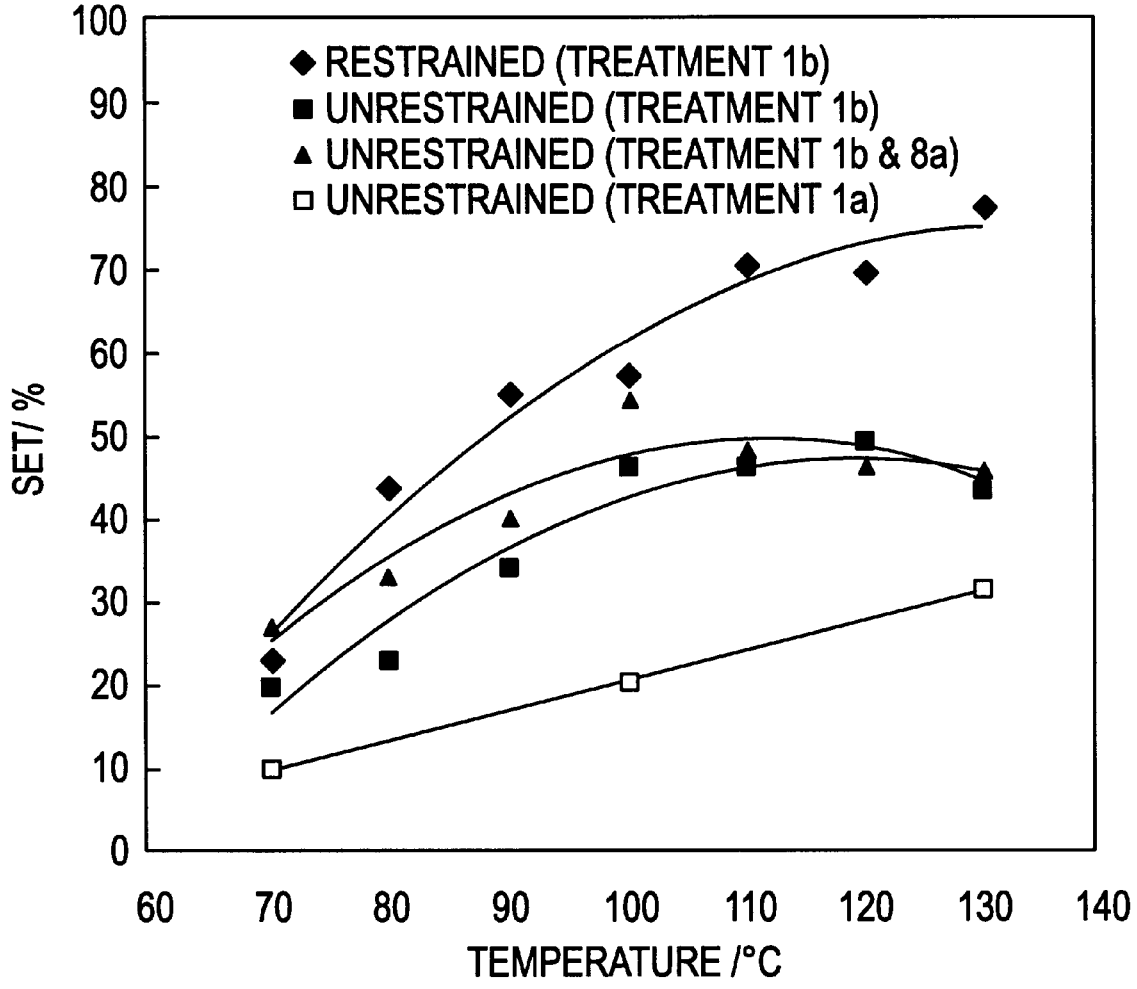

The level of permanent set remaining after treatment in an unrestrained manner as outlined for FIG. 8 is given below for the following treatments.

| Treatment | Unrestrained Permanent Set/% |
|---|---|
| As for Example 1a | 21 |
| As for Example 1b | 46 |
| As for Example 8a | 54 |
| As for Example 2a | 42 |

Example 10

Easy Care Permanent Press Properties

A gaberdine fabric was given a shrink resist treatment (BAP/silicone) and sewn in the shape of a trouser leg and steam pressed so that it contained two seams and two central creases. This trouser leg was conditioned to 75% relative humidity and then suspended unrestrained in a large annealing vessel and treated under similar conditions as outlined in example 1b followed by the additional thiol removal treatment as outlined in example 8a. An additional trouser was also constructed from the shrink resist fabric but it had no further treatment and acted as the control.

These trousers were given 7, 5a wash cycles in a Wascator according to the washing procedure outlined in International Wool Secretariat test method TM 31 (1986) with a 30 minute warm tumble dry between washes.

The trousers were then examined for shrinkage and appearance of seams, pleats and fabric smoothness. Although the area shrinkage for both legs was less than 1% the general appearance of the treated was superior as it still retained sharp central creases and flat seams compared to the untreated trouser that lost its flat seams and creases entirely after the first wash. The smoothness of the tumble dried treated fabric was also superior to the untreated fabric.

Example 11

Smooth Dry Performance

The smooth dry performance or recovery from wrinkles inserted when the fabric is wet is shown below. The fabric was treated according to example 1b and given an additional after treatment according to example 8a. The smooth dry performance of wool that has been soaked in water for 30 minutes, padded to remove excess water, wrinkled for 15 minutes, and allowed to recover for 15 minutes using the multiple pleat test (3) is given below.

| Treatment | Wrinkle Recovery (%) |
|---|---|
| Untreated | 53 |
| Treatment 1b and 8a | 72 |

Example 12

Hygral Expansion Improvement

Fabric that had been pieced dyed was treated according to the treatment outlined in example 1b and given an after treatment as outlined in example 8b. The hygral expansion was then measured by marking the fabric in both the warp and weft directions and measuring the difference in length between the wet fabric and after drying in an oven for 1 hour at 100° C. The hygral expansion is given by the difference between the wet and dry lengths expressed as a percentage of the dry length. The average of the warp and weft are given below.

| Treatment | Hygral expansion (%) |
|---|---|
| Untreated | 7 |
| Treatment 1b and 8b | 5 |

The above examples demonstrate that a significant reduction in regain at high relative humidity or when wet will provide a substantial improvement in the properties of wool that deteriorate under these conditions. This reduction in regain is achieved by annealing at reduced regain under conditions in which appreciable disulfide interchange is possible, for example by the addition of thiols to wool in order to facilitate the rearrangement. This treatment is also applicable to other material other than wool in which disulfide bonds can be rearranged and the crosslinks reformed so as to restrict the absorption of water.

The described arrangement has been advanced merely by way of explanation and many modifications may be made thereto without departing from the spirit and scope of the invention which includes every novel feature and combination of novel features herein disclosed.

We claim:

1. A process for treating fabric made from proteinaceous materials containing disulfide or polysulfide bonds comprising annealing the fabric at a temperature in the range of from 70° C. to 160° C. at a regain of between 10% and 25% for a period greater than about 10 minutes wherein the fabric is annealed in the presence of a gas which enhances the disulfide interchange reaction.

2. The process according to claim 1, wherein the gas is selected from the group consisting of thiol reducing agents, phosphine reducing agents, triethyl phosphite and sulfur dioxide.

3. The process according to claim 2, wherein said thiol reducing agent is selected from the group consisting of hydrogen sulfide, polysulfides of the formula $H_2S_2$, $H_2S_3$ and $H_2S_4$, thioglycollic acid, 1,4-dithiothreitol, mercaptoethanol, benzyl mercaptan, ethanethiol, benzenethiol, and 2-aminoethanethiol; and said phosphine reducing agent is selected from the group consisting of phosphine, tris(hydroxmethyl)phosphine, tri-n-butylphosphine, tri-ethylphosphine and tertiary phosphines derived from phosphine by reaction with amines and formaldehyde.

4. A process according to either claim 1 or claim 2 wherein the gas is hydrogen sulfide ($H_2S$).

5. A process according to any one of claim 1 or 2 wherein the annealing of the fabric is carried out at a temperature of approximately 100° C. at a regain of approxinately 15% for a period of about 4 hours.

6. A process for treating a fabric made from proteinaceous materials containing disulfide or polysulfide bonds comprising annealing the fabric at a temperature in the range of from 70° C. to 160° C. to a regain of between 10% and 25% for a period greater than 10 minutes herein the fabric has at least in part been treated with a liquid which enhances the disulfide interchange reaction.

7. The process according to claim 6, wherein the liquid is selected from the group consisting of thiol reducing agents, phosphine reducing agents, triethyl phosphite, borohydride, bisulfite, sulfite, dithionite, monoethanolamine sesquisulfite, sulfide, hydrosulfide, and sulfur dioxide, and thiolating agents.

8. The process according to claim 7, wherein said reducing agent is selected from the group consisting of hydrogen sulfide; polysulfides of the form $H_2S_2$, $H_2S_3$, and $H_2S_4$, thioglycollic acid, 1,4-dithiothreitol, mercaptoethanol, benzyl mercaptan, ethanethiol, benzenethiol, 2-aminoethanethiol and cysteine; said phosphine reducing agent is selected from the group consisting of phosphine, tetrakis(hydroxmethyl)phosphonium chloride, tris (hydroxmethyl)phosphine, tri-n-butylphosphine, triethylphosphine and tertiary phosphines derived from phosphine by reaction with amines and formaldehyde; and said thiolating agent is selected from the group consisting of acetylmercaptosuccinic anhydride, N-acetyl-homocysteine thiolactone, homocysteine thiolactone and thioglycolides.

9. A process according to either claim 6 or claim 7 wherein the liquid is selected from the group consisting of hydrogen sulfide, thiogycollic acid, 1,4-dithiothreitol, mercaptoethanol, benzyl mercaptan, ethanethiol, benzenethiol, cysteine, bisulfite, sulfite, dithionite, monoethanolamine sesquisulfite, sulfide, hydrosulfide, sulfur dioxide and thioglycolides.

10. A process according to any one of claim 6 or 7 wherein the fabric is annealed at a temperature of approximately 100° C. at a regain of approximately 15% for a period of about 4 hours.

11. A process according to any one of claim 1, 2, 6 or 7 wherein the fabric is selected from the group consisting of woven and non-woven cloths, knitted fabrics and felted fabrics.

12. A process according to any one of claim 1, 2, 6, or 7 wherein the fabric is a high quality worsted fabric.

13. A process according to any one of claim 1, 2, 6, or 7 wherein the fabric is in the form of an article.

14. A process according to any one of claim 1, 2, 6 or 7 wherein the fabric is in the form of a garment.

15. A process according to any one of claim 1, 2, 6 or 7 wherein the proteinaceous materials containing disulfide or polysulfide bonds are selected from keratin containing materials, wool, wool with reduced crystallinity, mohair, regenerated protein or mixtures thereof.

16. A process according to any one of claim 1, 2, 6 or 7 wherein the fabric is made from wool or from a blend of wool and other materials.

17. A process according to any one of claim 1, 2, 6 or 7 wherein the fabric is annealed in an atmosphere having a relative humidity in the range of from 30 to 95%.

18. A process according to any one of claim 1, 2, 6 or 7 wherein the fabric is annealed in an atmosphere having a relative humidity of 75 to 85%.

19. A process for permanently setting a fabric comprising the process of any one of claim 1, 2, 6 or 7.

20. A process for permanently setting a fabric according to claim 19 wherein said process for permanently setting the fabric comprises an additional shrink resist treatment.

21. A fabric produced by the process of any one of claim 1, 2, 6 or 7.

22. An article made from a fabric which article has been treated by the process according to any one of claim 1, 2, 6 or 7.

23. A garment treated by the process according to any one of claim 1, 2, 6 or 7.

24. A fabric produced by the process according to claim 19.

25. An article made from a fabric which article has been treated by the process according to claim 19.

26. A garment treated by the process according to claim 19.

* * * * *

UNITED STATES PATENT AND TRADEMARK OFFICE

CERTIFICATE OF CORRECTION

PATENT NO. : 5,928,383
DATED : Jul. 27, 1999
INVENTOR(S) : Ian Maxwell Russell, et al It is certified that error appears in the above-identified patent and that said Letters Patent is hereby corrected as shown below:

On the Cover Page, in the [73] Assignee: section,

"The Commonwealth Scientific and Industrial Research Organization", should be

--Commonwealth Scientific and Industrial Research Organisation--.

in the [30] Foreign Application Priority Data: section,

"Oct. 17, 1997 [AU] Australia ..... PM8852/94", should be

--Oct. 17, 1994 [AU] Australia ..... PM8852/94--.

Signed and Sealed this

Thirteenth Day of June, 2000

*Attest:*

Q. TODD DICKINSON

*Attesting Officer*

*Director of Patents and Trademarks*